US005601255A

United States Patent [19]

Romer et al.

[11] Patent Number: 5,601,255

[45] Date of Patent: Feb. 11, 1997

[54] METHOD AND APPARATUS FOR FLIGHT PATH CORRECTION OF PROJECTILES

[75] Inventors: Rudolf Romer, Kaarst; Gerd Wollmann, Oberhausen; Helmut Misoph, Lauf a.d. Pegnitz, all of Germany

[73] Assignees: Rheinmetall Industrie GmbH, Ratigen; TZN Forschungs-und Entwicklungszentrum Unterluss, GmbH, Uterluss, both of Germany

[21] Appl. No.: 438,018

[22] Filed: May 8, 1995

[30] Foreign Application Priority Data

May 7, 1994 [DE] Germany ..... 44 16 211.1

[51] Int. Cl.[6] ..... F41G 7/26

[52] U.S. Cl. ..... 244/3.13

[58] Field of Search ..... 244/3.11, 3.13

[56] References Cited

U.S. PATENT DOCUMENTS

| | | | |
|---|---|---|---|
| 4,174,818 | 11/1979 | Glenn | 244/3.13 |
| 4,209,224 | 1/1980 | Stewart, Jr. | 350/6.4 |
| 4,324,491 | 4/1982 | Hueber | 244/3.13 |
| 4,441,669 | 4/1984 | Wich | 244/3.13 |
| 4,709,875 | 12/1987 | Cremosnik et al. . | |
| 5,018,684 | 5/1991 | Allgaier et al. | 244/3.13 |
| 5,163,637 | 11/1992 | Hansen | 244/3.21 |
| 5,344,099 | 9/1994 | Pittman et al. | 244/3.13 |
| 5,414,430 | 5/1995 | Hansen | 342/188 |
| 5,427,328 | 6/1995 | Tong et al. | 244/3.13 |
| 5,490,643 | 2/1996 | Jano et al. | 244/3.11 |

FOREIGN PATENT DOCUMENTS

| | | |
|---|---|---|
| 3117685 | 8/1983 | Germany . |
| 3429322 | 11/1985 | Germany . |
| 2543606 | 11/1986 | Germany . |
| 68916058 | 8/1989 | Germany . |
| 1605212 | 1/1970 | United Kingdom . |
| 1177950 | 1/1970 | United Kingdom . |
| WO83/02165 | 6/1983 | WIPO . |

*Primary Examiner*—Michael J. Carone
*Assistant Examiner*—Christopher K. Montgomery
*Attorney, Agent, or Firm*—Spencer & Frank

[57] ABSTRACT

A method and an apparatus for flight path correction of one or more projectiles (2–6) with the aid of a guide beam (9), wherein target data, such as speed, range and direction of movement, are continuously acquired in a fire-guidance system associated with the firing device (1), for example, an automatic cannon, and are transmitted to the laser apparatus (21) that produces the guide beam (9), and wherein each projectile includes a receiving apparatus (31) which receives the guide beam (9). To be able to correct, in a simple manner with a pulse correction, both individual projectiles as well as a plurality of projectiles flying closely behind one another in time and having different courses, the guide beam (9) is aimed toward the collision point (15) calculated on the basis of the target data, and the guide beam (9) is subdivided into a plurality, at least five, partial beams (guide beam segments 10–14) including a central guide beam segment (10) which is aimed at the collision point (15) and around which the remaining partial beams or beam segments are disposed. The guide beam segments (10–14) are all modulated differently. Each projectile (2–6), with the aid of its respective receiving apparatus (31), then determines the angular position necessary for the correction, with respect to the collision point (15), from the modulation of the respective received guide beam segment (10–14).

11 Claims, 3 Drawing Sheets

METHOD AND APPARATUS FOR FLIGHT PATH CORRECTION OF PROJECTILES

REFERENCE TO RELATED APPLICATIONS

This application is related to Applicants' concurrently filed U.S. patent application Ser. No. 08/438,019, which corresponds to German application No. P 44 16 210.3, filed May 7, 1994, which are incorporated herein by reference.

This application claims the priority of German application Serial No. P44 16 211.1, filed May 7, 1994, which is incorporated herein by reference.

BACKGROUND OF THE INVENTION

The invention relates to a method of flight path correction of one or more projectiles with the aid of a laser guide beam. More particularly, the present invention relates to a method of flight path correction of projectiles employing a guide beam, wherein target data, such as speed, range and direction of movement, are continuously acquired in a fire-guidance system associated with the firing device and are transmitted to the laser apparatus that produces the guide beam, and wherein the respective projectiles each include a receiving apparatus which receives the guide beam. The invention further relates to an apparatus for performing the method.

To increase hit probability, particularly in combat involving moving targets, correction of the projectile flight path, especially at an increased range, is imperative in addition to optimum fire control and a short flight time. For this type of target combat, it is known to use seeking fuze projectiles that have a correspondingly complex sensor arrangement in the projectile tip, or beam-guided projectiles. In beam-guided projectiles, the guide beam can either illuminate the target, in which case the projectile again must have a correspondingly complex sensor arrangement in the projectile tip, or the guide beam is aimed at the missile and guides it to the target according to the data obtained with the fire-guidance system.

In the latter method, it is only possible, with a justifiable outlay, to guide a single projectile to the target with the respective guide beam. Methods of this type are therefore typically used only to guide high-caliber missiles (artillery projectiles or tank projectiles).

A method of flight path correction for rotating projectiles is known from German Patent 25 43 606 C2. In this instance, first a course measurement of the respective projectile is taken by means of an optical device associated with the weapon carrier. The data are then transmitted to the projectile with the aid of the laser guide beam in order to trigger an appropriate correction pulse, and the rolling position angle of the projectile is determined by a corresponding evaluation apparatus in the projectile itself.

A disadvantage of this method as well is that the flight path of only one projectile, not of a plurality of projectiles flying closely one behind the other in time, can be corrected. The quasi-simultaneous correction of projectiles of an automatic cannon volley (swarm) is therefore not possible with this known apparatus.

SUMMARY OF THE INVENTION

It is an object of the invention to provide a method of flight path correction in which both individual projectiles as well as a plurality of projectiles flying closely behind one another in time and having different courses can be corrected in a simple manner with a pulse correction. A further object of the invention is to disclose an apparatus for performing the method.

The above object, with regard to the method, generally is achieved according to the present invention by a method of flight path correction of at least one projectile employing a guide beam, with the method including continuously acquiring target data, such as speed, range and direction of movement, in a fire-guidance system associated with a firing device for the at least one projectile, transmitting the target data to a laser apparatus that produces the guide beam, receiving the guide beam by a respective receiving apparatus on each of the at least one projectile within the guide beam, and correcting the course of the at least one projectile in response to the target data on the guide beam; the improvement comprising:

a) orienting the guide beam toward a collision point, calculated on the basis of the target data, of a target being tracked and the at least one projectile;

b) subdividing the guide beam into guide beam segments (partial beams) including a central guide beam segment that is oriented toward the collision point and a plurality of outer guide beam segments disposed around the central guide beam segment;

c) differently modulating each of the guide beam segments; and, d) with the aid of the respective receiving apparatus, determining the angular position necessary for the correction, with respect to the collision point, of the respectively associated at least one projectile from the modulation of the particular guide beam segment in which the respectively associated at least one projectile is located.

Preferably, there are at least four of the outer guide beam segments disposed symmetrically around the central guide beam segment, and the step of subdividing includes selecting the distance between the center points of the individual outer guide beam segments from the center point of the central guide beam segment such that the distance corresponds to the maximum possible correction. According to a further feature of the invention, when rotating projectiles are involved then the central guide beam segment is additionally phase-modulated and the roll position of the respective projectile is determined with the aid of a corresponding demodulator in the respective projectile.

The above object, with regard to the apparatus, generally is achieved according to the present invention by an apparatus for correcting the flight path of at least one projectile disposed within a guide beam, with the apparatus including a laser apparatus which is associated with a firing apparatus for the projectiles and which produces a guide beam, a fire-guidance system that tracks a target, and a receiving apparatus disposed in each respective projectile and connected to a corresponding correction device on the respective projectile for the purpose of changing the flight path of the respective projectile; and wherein: the laser apparatus can be moved by appropriate signals from the fire-guidance system such that the guide beam continuously tracks the target; the laser apparatus includes means for subdividing the guide beam into at least five guide beam segments including a central guide beam segment whose axis is aimed at the target and at least four outer guide beam segments disposed symmetrically around the central guide beam segment; and the laser apparatus includes a plurality of modulators for modulating each of the guide beam segments with a different modulation so that the receiving apparatus of a respective projectile can identify the particular guide beam segment in which it is located and take the data necessary for the correction from the received guide beam.

Preferably, the means for subdividing includes a number of beam splitters, corresponding to the number of guide beam segments, disposed in the beam path of a laser; a respective one of the modulators is provided on the side of each of the beam splitters facing away from the laser for the purpose of modulating the respective guide beam segments; and a respective diverting mirror is provided for each of the modulated the outer guide beam segments to align the outer, modulated guide beam segments such that, at a predeterminable range, the distance of the center points of the outer guide beams segments from the center point of the central guide beam segment corresponds to the maximum possible correction.

Further advantageous features modifications and embodiments of the invention are disclosed and claimed.

The essential concept of the invention is not to aim the guide beam at the respective projectile, but at the target, and track it. At a time determined by the data required for correction, the individual projectiles take the data autonomically from the guide beam itself.

For this purpose, the guide beam comprises a central guide beam segment, which remains aimed at the target, and at least four outer guide beam segments disposed around the central segment. The light beam of each of the guide beam segments is modulated differently for each segment, so that the projectiles located in the guide beam can determine their course based on the respective received modulation, and know in which direction they must be corrected. If, moreover, the distance between the center points of the individual, outer guide beam segments and the inner guide beam segment corresponds to the maximum correction, and if the directional angle of correction in the respective outer guide beam segment is constant, the projectile axis always lies within the central guide beam segment following correction. With the aid of evaluation electronics located in each respective projectile, this information is used to determine the optimum ignition or trigger time for the appropriate correction charge.

The method of the invention also has the advantage that the entire system practically cannot be visually disturbed from the target, because no information is transmitted from the projectile to the ground station. Furthermore, scanning and allocating individual bits of information to certain projectiles are omitted.

In the case of pulse correction of rotating projectiles, the roll position of the projectile, which is necessary for the precise correction time, preferably can be determined in that the central guide beam segment is phase-modulated with the aid of a holographic optical element, i.e., a defined phase structure is produced in the guide beam. Since the information is stored in the guide beam as phase information, it is not necessary to align the corresponding reception detector in each respective projectile to be coaxial to the guide beam. Rather, the receiving detector of a respective projectile can be at some location within the guide beam; however, a prerequisite for this is that the respective detector be oriented parallel to the guide beam axis within specific limits.

The laser apparatus for performing the method of the invention essentially comprises the laser itself and a beam-splitter arrangement having modulators for producing a predetermined number of differently-modulated guide beam segments.

In its tail-side or rear part, each projectile has a receiving apparatus essentially comprising receiving optics that include a holographic element configured as a polarizer or polarization filter, two receiving detectors and an electronic evaluation unit. One of the receiving detectors serves, in conjunction with the holographic element, to measure of the roll position of the projectile. The second receiving detector serves to determine the course measurement through determination of the modulation and, if need be, to measure the target range transmitted by the laser apparatus.

Further details and advantages of the invention ensue from the following embodiments, which are explained in conjunction with the drawing figures.

DETAILED DESCRIPTION OF THE PREFERRED EMBODIMENT

Figure 1:
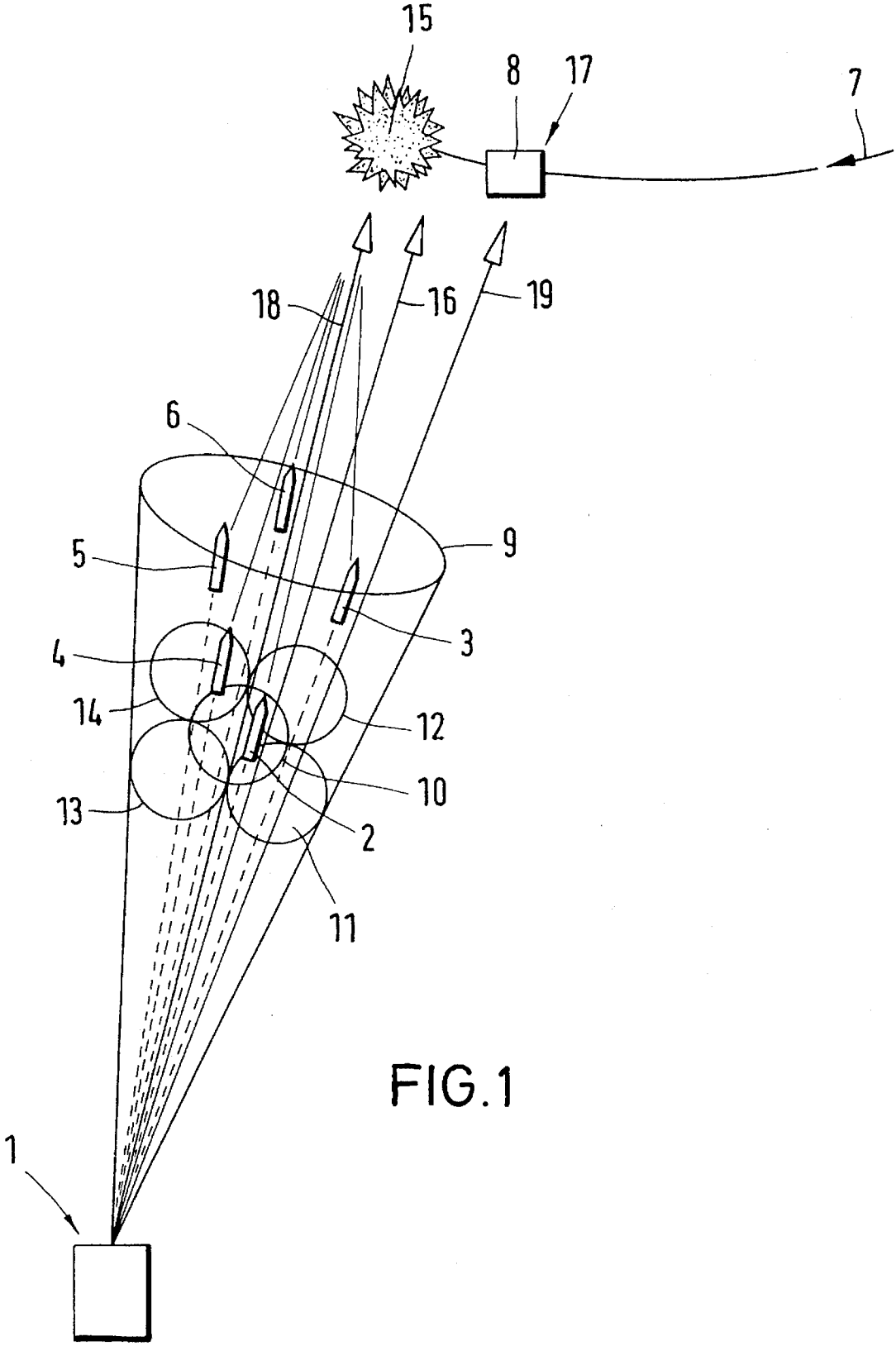
FIG. 1 is a schematic representation of the apparatus and guide beam for explaining the function principle of the present invention.

Shown schematically in FIG. 1 and indicated by 1 is a machine gun or automatic cannon having an integrated fire-guidance system for target data acquisition, and a laser apparatus for producing a guide beam. A volley of five projectiles 2–6 (swarm) is fired or launched from the machine gun or automatic cannon at a target 8 moving in the direction of arrow 7.

The laser apparatus produces a guide beam 9, which comprises a plurality of guide beam segments, preferably five guide beam segments 10–14 as shown, with the individual guide beam segments being represented by beam cross-sections (circles) rotated into the viewing plane in FIG. 1. The plurality of guide beam segments includes a central guide beam segment 10 with the outer guide beam segments 11–14 surrounding, preferably symmetrically as shown, the central guide beam segment 10.

Based on the target data acquired by the fire-guidance system, guide beam 9 is aimed at a calculated collision point 15, and projectiles 2–6 located within the beam 9 are correspondingly corrected. The flight direction of the swarm of projectiles 2–6 prior to correction based on the target located at position 17 is indicated by 16, and the center axis of guide beam 9, and thus also of the central guide beam segment 10, is indicated by 18. The beam of the fire-guidance system that scans target 8 is provided with reference numeral 19 in FIG. 1.

Figure 2A:
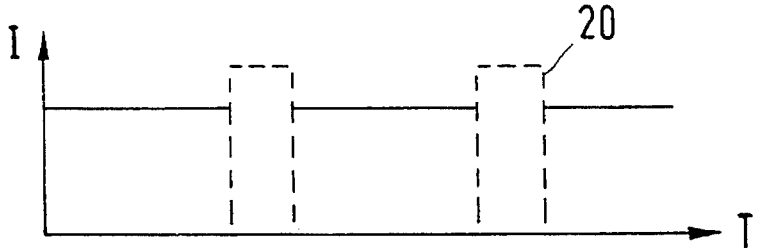
FIGS. 2*a*–2*e* are pulse diagrams for explaining the modulation of the respective guide beam segments.
Figure 2B:
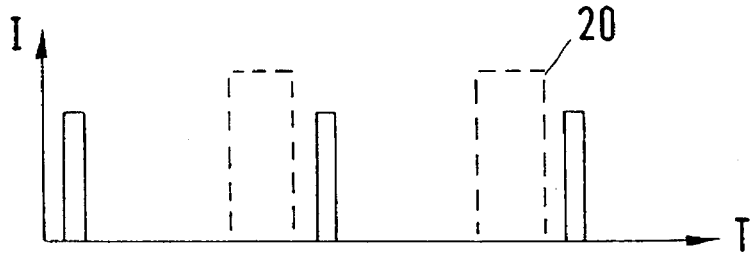
Figure 2C:
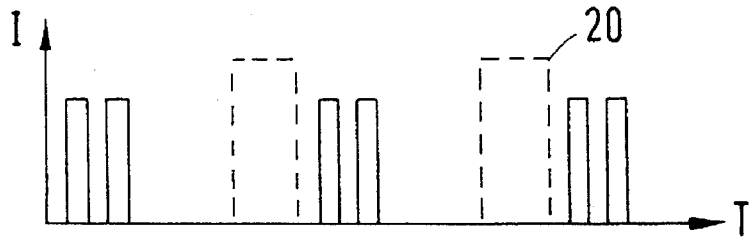
Figure 2D:
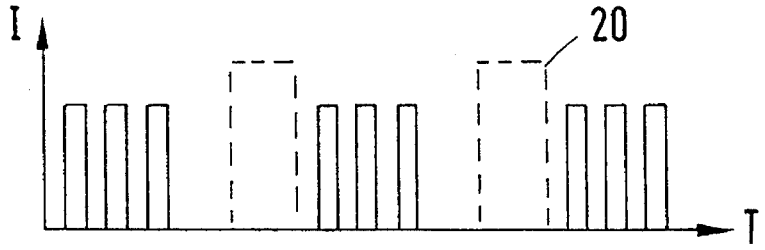
Figure 2E:
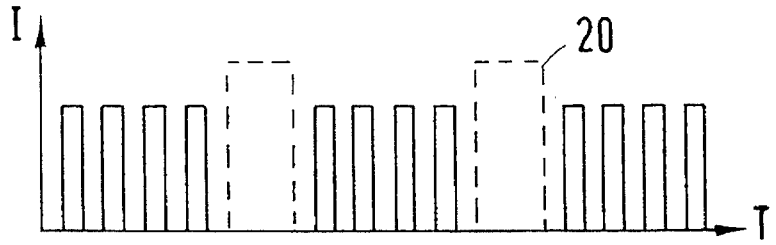

Guide beam segments 11–14 are modulated differently for measuring or correcting the course of the individual projectiles of the swarm. This is represented schematically in FIGS. 2*a* through 2*e*, with the intensity of the beam segments being indicated by I and the time being indicated by T. FIG. 2*a* shows the intensity characteristic of guide beam segment 10, and FIGS. 2*b*–2*e* show the corresponding intensity characteristics of segments 11–14.

Guide beam segment 10 advantageously covers the surface of the target for a predetermined target range (e.g., 4000 m). In the correction range (e.g., 1000 to 2000 m from the automatic cannon 1), the distance of the center points of the outer guide beam segments 11–14 from the center point of the central guide beam segment 10 must correspond to the maximum possible correction for the projectiles.

The pulse series 20 shown in dashed lines in FIGS. 2*a*–2*e* characterizes the distance between laser apparatus of automatic cannon 1 and target 8 determined with the aid of the fire-guidance system. This distance, in addition to the angular course and roll angle position of the projectile, is necessary for determining the time of ignition of the correction charge of the respective projectile. This information is present in all five guide beam segments 10–14.

Figure 3:
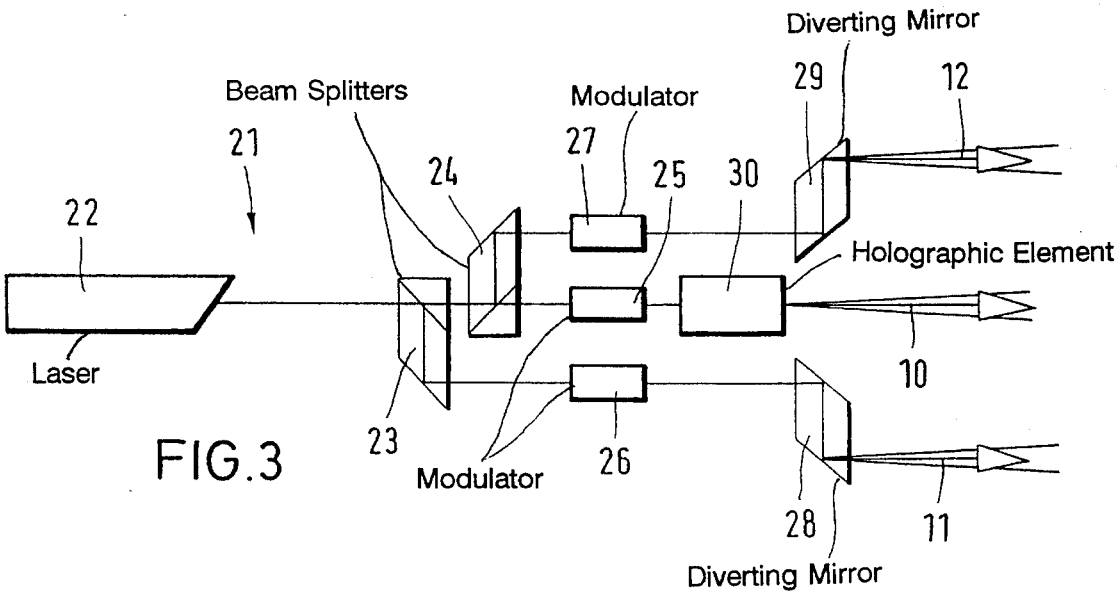
FIG. 3 is a schematic block diagram of a laser apparatus for producing modulated guide beam segments according to the invention.

A laser apparatus 21 for producing the individual guide beam segments is represented schematically in FIG. 3. For the sake of a clear overview, only the production of three segments, 10 through 12 of FIG. 1 is shown. Laser apparatus 21 essentially comprises the actual laser 22, a number of beam splitters 23, 24 corresponding to the number of outer guide beam segments, a corresponding number of modulators 25–27, and a corresponding number of diverting mirrors 28, 29. As shown, the respective beam splitters 23 and 24 are disposed in the beam produced by the laser 22 to provide a central guide beam segment 10 and respective outer guide beam segments 11 and 12. The guide beam segments 10–12 are passed through respective modulators 25–27, and the modulated outer guide beam segments 11 and 12 are passed to respective diverting mirrors 28 and 29 which direct or align the respective outer guide beam segments 11 and 12 such that, at a predetermined range within the above mentioned correction range, the distance of the center points of the outer guide beams segments 11–14 from the center point of the central guide beam segment 10 corresponds to the maximum possible correction.

Moreover, in desired pulse correction of rotating projectiles (e.g. spin-stabilized projectiles), a holographic element 30 can be provided which additionally phase-modulates the central guide beam segment 10. With this method, in connection with a further holographic element in the receiving apparatus of the respective projectile, an absolute angle determination (determination of rolling position) is possible.

Figure 4:
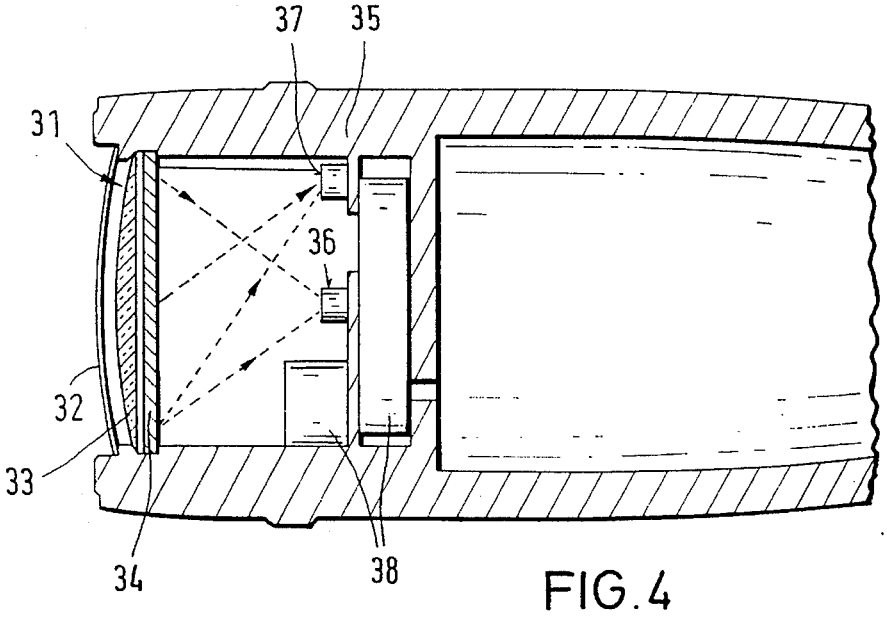
FIG. 4 is a schematic partial sectional view showing the design of the receiving apparatus disposed in the tailside part of a projectile.

A corresponding receiving apparatus 31 of a respective projectile 2–6 is represented in FIG. 4, and is described in greater detail in the above mentioned concurrently filed U.S. patent application Ser. No. 08/438,019. The receiving apparatus 31 is protected toward the outside by either a protective cap (not shown) which is separated after the barrel is exited, or by a transparent cover plate 32, and essentially comprises a lens 33, the further holographic element 34, which is fixedly connected to the projectile bottom 35 at its edge and which simultaneously is configured as a polarizer, as well as two receiving detectors 36, 37 and evaluation electronics 38.

The function of the receiving apparatus is described below:

After firing, the reference roll position of the respective projectile 2–6 is determined with the aid of holographic element 34 and receiving detector 37 up to a range of, for example, approximately 1000 m. The momentary roll position of the projectile or missile 2–6 can subsequently be determined in the respective projectile for any given moment, and in a conventional manner, by extrapolation involving the changes in intensity caused by the use of a polarization filter (likewise formed by holographic element 34 in the illustrated embodiment).

When a predetermined distance range of, for example, 1000 to 2000 m is reached, receiving detector 36 is activated by evaluation electronics 38 in the respective projectile 2–6 in order to determine the course. Based on the modulation of the received signals, the respective evaluation electronics 38 determines in which guide beam segment 10–14 the associated respective projectile 2–6 is located. If the associated projectile is located in central guide beam segment 10, no correction is initiated. Alternatively, if the associated projectile is located in one of the outer guide beam segments 11–14, then the direction in which a projectile correction must take place is determined on the basis of the received modulation.

Because, in the predetermined distance range, the maximum correction corresponds to the distance of the center points of the respective outer guide beam segments 11–14 from the central guide beam segment 10, and the directional angle of the correction in the respective outer guide beam segment 11–14 is constant (in the present embodiment, 45° in each quadrant), following the correction the projectile axis will always lie within the central guide beam segment 10 (i.e., each point of the outer circular surface is displaced parallel toward the inner circular surface 10 (FIG. 1). With the aid of evaluation electronics 38, this information is used to determine the optimum trigger time for the correction charge of the respective projectile.

The invention now being fully described, it will be apparent to one of ordinary skill in the art that any changes and modifications can be made thereto without departing from the spirit or scope of the invention as set forth herein.

What is claimed:

1. In a method of flight path correction of at least one projectile employing a guide beam, with said method including continuously acquiring target data, including speed, range and direction of movement, in a fire-guidance system associated with a firing device for the at least one projectile, transmitting the target data to a laser apparatus that produces the guide beam, receiving the guide beam by a respective receiving apparatus on each of the at least one projectile within the guide beam, and correcting the course of the at least one projectile in response to the target data on the guide beam; the improvement comprising:

a) orienting the guide beam toward, a collision point of a target being tracked and the at least one projectile which was calculated on the basis of the target data;

b) subdividing the guide beam into guide beam segments (partial beams) including a central guide beam segment that is oriented toward the collision point and is selected such that it covers the surface of a predetermined target for a predetermined target range, and a plurality of outer guide beam segments disposed around the central guide beam segment, with the step of subdividing including selecting the distance between the center points of the individual outer guide beam segments from the center point of the central guide beam segment such that said distance corresponds to the maximum possible correction in one predetermined correction range after firing;

c) differently modulating each of the guide beam segments; and, d) with the aid of the respective receiving apparatus, determining the angular position necessary for the correction, with respect to the collision point, of the respectively associated at least one projectile from the modulation of the particular guide beam segment in which the respectively associated at least one projectile is located, with the angular position necessary for correction being determined in the respective receiving apparatus of the associated projectile by evaluating the modulation of the particular guide beam segment in only said one predetermined correction range after being fired, and then initiating a single correction accordingly.

2. A method as defined in claim 1, wherein there are at least four of said outer guide beam segments disposed symmetrically around said central guide beam segment.

3. A method as defined in claim 1, wherein said correction range of the at least one projectile is selected to be within a defined distance range from the firing device.

4. A method as defined in claim 3, wherein said distance range is between 1000 and 2000 m from the firing device.

5. A method as defined in claim 1, further comprising phase-modulating the central guide beam segment and determining the roll position of the respective projectile with the aid of a corresponding demodulator in the respective projectile.

6. A method as defined in claim 1, wherein a plurality of said projectiles, which are flying closely following one another, are disposed simultaneously in the guide beam, and each projectile receives a guide beam segment and, after evaluation of the modulation of the particular guide beam segment in said one predetermined correction range, initiates any necessary correction for the respective projectile.

7. A method as defined in claim 6, including subjecting each projectile to only a maximum of a single correction within said predetermined correction range.

8. In an apparatus for correcting the flight path of at least one projectile disposed within a guide beam, with said apparatus including a laser apparatus which is associated with a firing apparatus for the projectiles and which produces a guide beam, a fire-guidance system that tracks a target, and a receiving apparatus disposed in each respective projectile and connected to a corresponding correction device on the respective projectile for the purpose of changing the flight path of the respective projectile; the improvement wherein: said laser apparatus can be moved by appropriate signals from said fire-guidance system such that the guide beam continuously tracks the target; said laser apparatus includes means for subdividing the guide beam into at least five guide beam segments including a central guide beam segment whose axis is aimed at the target and at least four outer guide beam segments disposed symmetrically around the central guide beam segment, with said means for subdividing including a number of beam splitters, corresponding to the number of said guide beam segments, disposed in the beam path of a laser; said laser apparatus contains a plurality of modulators for modulating each of said guide beam segments with a different modulation so that the receiving apparatus of a respective projectile can identify the particular guide beam segment in which it is located and take the data necessary for the correction from the received guide beam, with a respective one of said modulators being provided on the side of each of said beam splitters facing away from said laser for the purpose of modulating the respective guide beam segments; a respective diverting mirror is provided for each of the modulated said outer guide beam segments to align the outer, modulated guide beam segments such that, at a predeterminable range, the distance of the center points of the outer guide beams segments from the center point of the central guide beam segment corresponds to the maximum possible correction in a predetermined correction range after firing; each of the said projectiles whose flight path is to be corrected is a rotating projectile; and said laser apparatus additionally includes a further modulator for phase-modulating the central guide beam segment, with the phase-modulation of the central guide beam segment being used by said receiving apparatus of a respective projectile to determine the roll position of the respective projectile.

9. An apparatus as defined in claim 8, wherein: said further modulator for the modulation of the central guide beam segment is a holographic optical element disposed in the central guide beam path; and a corresponding holographic element is connected to each respective said projectile and disposed in the receiving apparatus of the respective projectile.

10. A method of flight path correction of at least one projectile employing a guide beam, with said method including continuously acquiring target data, including speed, range and direction of movement, in a fire-guidance system associated with a firing device for the at least one projectile, transmitting the target data to a laser apparatus that produces the guide beam, receiving the guide beam by a respective receiving apparatus on each of the at least one projectile within the guide beam, and correcting the course of the at least one projectile in response to the target data on the guide beam; the improvement comprising:

a) orienting the guide beam toward a collision point of a target being tracked and the at least one projectile which was calculated on the basis of the target data;

b) subdividing the guide beam into guide beam segments (partial beams) including a central guide beam segment that is oriented toward the collision point and a plurality of outer guide beam segments disposed around the central guide beam segment;

c) differently modulating each of the guide beam segments;

d) with the aid of the respective receiving apparatus, determining the angular position necessary for the correction, with respect to the collision point, of the respectively associated at least one projectile from the modulation of the particular guide beam segment in which the respectively associated at least one projectile is located;

e) phase-modulating the central guide beam segment; and, f) determining the roll position of the respective projectile with the aid of a corresponding demodulator in the respective projectile.

11. A method as defined in claim 10 wherein there are at least four of said outer guide beam segments disposed symmetrically around said central guide beam segment.

* * * * *